US008607473B2

(12) United States Patent
Choi et al.

(10) Patent No.: US 8,607,473 B2
(45) Date of Patent: Dec. 17, 2013

(54) DRYER DOOR AND DRYER COMPRISING THE SAME

(75) Inventors: Yeon-Sik Choi, Gyeongsangnam-Do (KR); Ju-Han Yoon, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 391 days.

(21) Appl. No.: 12/935,543

(22) PCT Filed: Jun. 2, 2009

(86) PCT No.: PCT/KR2009/002929

§ 371 (c)(1),
(2), (4) Date: Nov. 3, 2010

(87) PCT Pub. No.: WO2009/148246

PCT Pub. Date: Dec. 10, 2009

(65) Prior Publication Data

US 2011/0037363 A1 Feb. 17, 2011

(30) Foreign Application Priority Data

Jun. 3, 2008 (KR) ..... 10-2008-0052320

(51) Int. Cl.
*F26B 11/02* (2006.01)

(52) U.S. Cl.
USPC ..... 34/603; 34/606; 34/610; 68/58; 68/196; 8/137; 8/159; 312/326; 16/412; 49/460; 220/377; D32/6; 52/205

(58) Field of Classification Search
USPC ..... 34/595, 601, 603, 606, 607; 68/24, 58, 68/138, 196; 8/137, 149, 159; 312/228, 312/329, 326; 16/412, 419; 49/460; 220/377, 212.5; D32/5, 6; 52/19, 52/504.593, 205
See application file for complete search history.

(56) References Cited

U.S. PATENT DOCUMENTS

| | | | | |
|---|---|---|---|---|
| 2,681,513 | A * | 6/1954 | Fowler | 34/82 |
| 3,959,891 | A * | 6/1976 | Burkall | 34/82 |
| 6,761,049 | B2 * | 7/2004 | Nitschmann et al. | 68/5 E |
| 7,559,156 | B2 * | 7/2009 | Renzo | 34/595 |
| 7,730,749 | B2 * | 6/2010 | Yun et al. | 68/3 R |
| 7,802,855 | B2 * | 9/2010 | Calmeise | 312/228 |
| 8,127,464 | B2 * | 3/2012 | Schone | 34/603 |
| 8,266,816 | B2 * | 9/2012 | Lim | 34/90 |
| 8,276,409 | B2 * | 10/2012 | Tooker | 68/196 |
| 2003/0110813 | A1 * | 6/2003 | Nitschmann et al. | 68/13 R |
| 2004/0020246 | A1 | 2/2004 | Yun et al. | |
| 2004/0159010 | A1 * | 8/2004 | Hwang | 34/601 |
| 2006/0265899 | A1 * | 11/2006 | Renzo | 34/603 |

FOREIGN PATENT DOCUMENTS

| | | | |
|---|---|---|---|
| DE | 10228602 | A1 | 2/2003 |
| EP | 1321559 | A1 | 6/2003 |
| EP | 1522623 | A1 | 4/2005 |

(Continued)

*Primary Examiner* — Steve M Gravini
(74) *Attorney, Agent, or Firm* — Birch, Stewart, Kolasch & Birch, LLP

(57) ABSTRACT

Disclosed are a door for a dryer and a dryer having the same, the door for the dryer having a concave portion or an inclined portion formed at an end surface of a door glass, such that an inner volume of the dryer can be enlarged without increasing the size of the dryer, under consideration of the dryer having the same capacity, resulting in allowing a large quantity of clothes to be dried at once.

6 Claims, 3 Drawing Sheets

(56) References Cited

FOREIGN PATENT DOCUMENTS

| | | | |
|---|---|---|---|
| JP | 10-94700 | A | 4/1998 |
| JP | 2004-65957 | A | 3/2004 |
| JP | 2005-95226 | A | 4/2005 |
| JP | 2008-93245 | A | 4/2008 |
| KR | 10-0271170 | B1 | 11/2000 |
| KR | 10-2007-0090802 | A | 9/2007 |

* cited by examiner

DRYER DOOR AND DRYER COMPRISING THE SAME

TECHNICAL FIELD

The present invention relates to a door for a dryer capable of enlarging an inner volume of the dryer, and a dryer having the same.

BACKGROUND ART

In general, a dryer is provided with a door installed at an upper surface or front surface thereof for putting clothes in or puling them out. The door is configured as a door glass such that a user can view the inner situation of the dryer through the glass from the outside. The door glass is typically formed of tempered glass or coated on its surface with a tempered coating so as to avoid the damage caused by an impact against the clothes or accessories attached to the clothes.

As an inlet for putting the clothes in is formed to be thick inwardly by a preset depth or a drum disposed within the inlet is installed with a specific interval from an inner wall surface of a case, the door glass is provided with a convex portion protruded in an inward direction of the drum by a preset height, so as to prevent the clothes from being entangled at the circumference of the inlet while drying the clothes. The front surface of the convex portion may be curved so as to be more convex in the protruded direction of the convex portion or may be formed to be planar.

However, with the configuration of the door glass employed in the related art dryer, as stated above, as the convex portion is formed in the inward direction of the drum and the front surface of the convex portion is formed to be more convex or planar, the space occupied by the convex portion increases so much, which causes a problem that the inner volume of the drum within the dryer is reduced under the same capacity of the dryer.

DISCLOSURE OF THE INVENTION

Therefore, to solve the problem of the door employed in the related art dryer, it is an object of the present invention to provide a door for a dryer capable of enlarging an inner volume of the dryer, with maintaining the outer appearance of the dryer, by varying the shape of the door glass, and a dryer having the same.

To achieve these objects, there is provided a door for a dryer including a door frame coupled to a main body having an inlet, and a door glass coupled to the door frame, wherein a central portion of the door glass positioned at a central portion of the inlet is disposed lower than a height of an edge of at least one portion of the door glass positioned at an inner side end of the inlet.

Here, the door glass may be provided with a convex portion protruded toward an inner space of the main body to be inserted in the inlet, and a concave portion recessed into an end surface of the convex portion in an opposite direction to the convex portion.

Alternatively, the door glass may have a convex portion protruded toward the inner space of the main body to be inserted in the inlet, and an end surface of the convex portion may have an inclined portion inclined downwardly.

In one aspect of the present invention, there is provided a dryer including a main body having an inlet for clothes, a drum installed inside the main body and communicated with the inlet to have an inner space for accommodating clothes to be dried, and a door configured to open and close the inlet of the main body, wherein the door may include a door frame coupled to the main body, and a door glass coupled to the door frame, wherein a central portion of the door glass positioned at a central portion of the inlet is lower than a height of an edge of at least one portion of the door glass positioned at an inner side end of the inlet.

Here, the door glass may be provided with a convex portion protruded toward an inner space of the drum to be inserted in the inlet, and a concave portion recessed into an end surface of the convex portion in an opposite direction to the convex portion.

A lint filter for filtering foreign materials out of air heat-exchanged with the clothes may be disposed at an inside of the inlet of the main body, and the convex portion of the door glass may have the end surface formed to have a length as long as not interfering with the lint filter.

Further, the door glass may have a convex portion protruded toward the inner space of the drum to be inserted in the inlet, and an end surface of the convex portion may have an inclined portion inclined downwardly.

A lint filter for filtering foreign materials out of air heat-exchanged with the clothes may be disposed at an inside of the inlet of the main body, and the inclined portion may be inclined such that the height of the convex portion is lowered toward the lint filter.

An end of the inclined portion close to the lint filter may be formed not to overlap with the lint filter.

ADVANTAGEOUS EFFECT

A door for a dryer according to the present invention can have a concave portion or an inclined portion formed at an end surface of a door glass, such that an inner volume of the dryer can be enlarged without increasing the size of the dryer, under consideration of the dryer having the same capacity, resulting in allowing a large quantity of clothes to be dried at once.

MODES FOR CARRYING OUT THE PREFERRED EMBODIMENTS

Reference will now be made in detail to a door for a dryer and a dryer having the same in accordance with the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Figure 1:
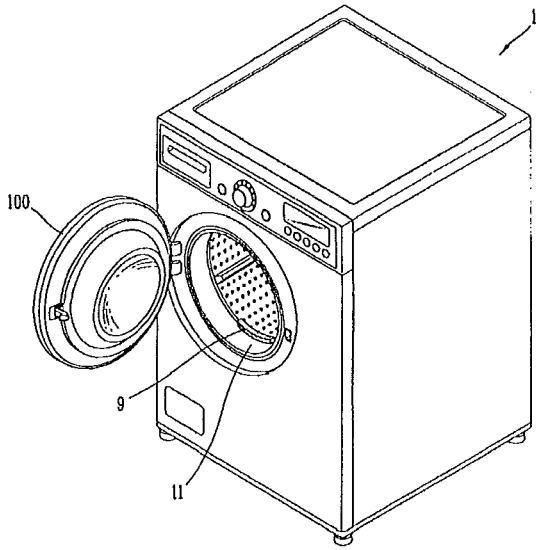
FIG. 1 is a perspective view showing an appearance of a dryer having a door according to the present invention.
Figure 2:
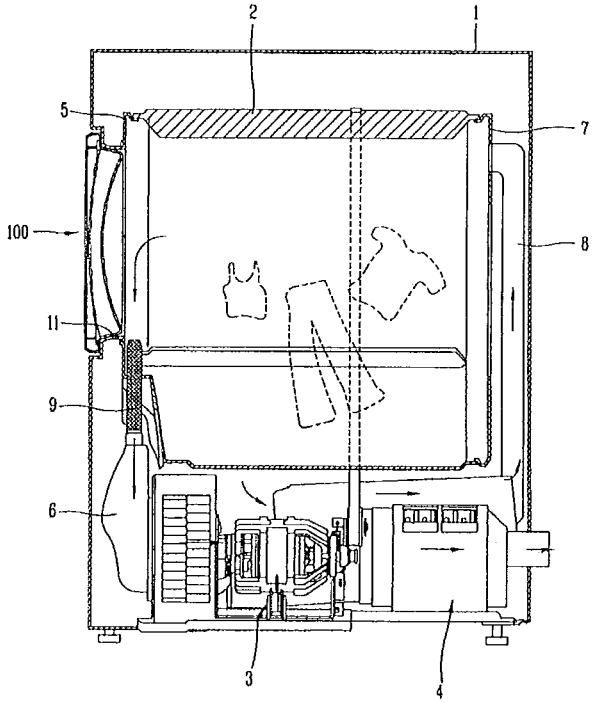
FIG. 2 is a longitudinal sectional view showing an inside of the dryer of FIG. 1.

As shown in FIGS. 1 and 2, a dryer having a door according to the present invention may include a case 1 configuring an outer appearance, a drum 2 rotatably installed in the case 1 for accommodating clothes therein, a hot air supplying unit 3 for generating hot air to be supplied into the drum 2, and a heat exchanging unit 4 for dehumidifying humid air discharged out of the drum 2.

An inlet 11 through which clothes are put into the drum 1 may be formed at a front surface of the case 1. A front cover 5 for supporting a front side of the drum 2 may be installed at an inner side end of the inlet 11. An exhaust duct 6 for guiding humid air flowed through the drum 2 to the outside of the case 1 may be installed below the front cover 5.

A rear cover 7 for supporting a rear side of the drum 2 is installed at a rear wall surface inside the case 1. The rear cover 7 may be provided with an air supply hole through which hot air is supplied into the drum 2. A suction duct 8 may be installed at a rear wall surface outside the drum 2 so as to communicate with the air supply hole. The hot air supplying unit 3 is installed at an inlet of the suction duct 8.

A lint filter 9 for filtering foreign materials out of air circulating in the exhaust duct 6 may be installed at the front cover 5. The heat exchanging unit 4 for dehumidifying humid air guided into the exhaust duct 6 may be installed at the exhaust duct 6.

With the configuration of the dryer according to the present invention, upon power being applied, the hot air supplying unit 3 is operated to suck external air and heats the sucked air up. The heated (hot) air is then guided toward the drum 2 via the suction duct 8. The hot air guided to the drum 2 is supplied into the drum 2 via the air supply hole formed at the rear cover 7. The hot air is heat-exchanged with wet clothes within the drum 2 to dry the clothes. Afterwards, the humid air is then guided toward the exhaust duct 6 disposed inside the case 1. The humid air flows through the lint filter 9 positioned at an upstream side of the exhaust duct 6 such that foreign materials are filtered out. The foreign material filtered humid air is discharged out of the case 1 via the exhaust duct 6. During the procedure, the series of processes, which the humid air is dehumidified via the heat exchanging unit 4 disposed in the middle of a passage of the exhaust duct 6 so as to be discharged out of the case 1, are repeated.

Here, the case 1 is provided with a door 100 coupled to the circumference of the inlet 11 by a hinge for opening and closing the inlet 11. The door 100, as shown in FIG. 1, may include a door frame 110 having one side coupled to the circumference of the inlet 11 by a hinge and another side detachably hooked at the case 1, and a door glass 120 coupled to the door frame 110 and formed of a transparent material such that an inner situation is viewable therethrough.

The door frame 110 is fabricated in an annular shape by using a material, which is non-transparent and has a specific intensity. The fabricated door frame 110 is then rotatably coupled to the case 1 by the hinge. A handle (not shown) is provided at one side of the door frame 110, namely, at an opposite side to the side being hinge-coupled.

The door glass 120 is formed of a transparent material, namely, glass. On a surface thereof facing the drum 2 may be coated with a surface reinforcing film for preventing the surface from being scratched or broken by clothes or accessories attached on the clothes.

The door glass 120 may be configured such that its inner surface, namely, the surface facing the drum 2 can be concave or inclined, thus to increase an inner volume of the drum 2.

Figure 3:
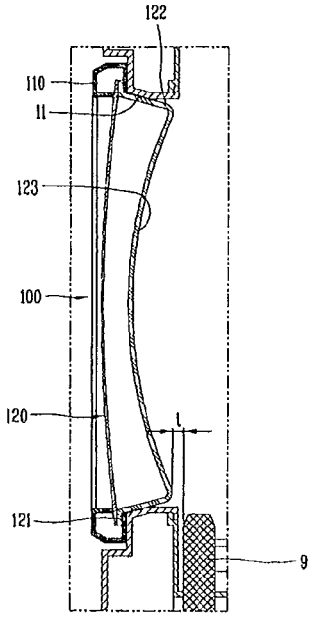
FIGS. 3 and 4 are longitudinal sectional view and perspective view, respectively, showing one embodiment of the door for the dryer of FIG. 1.
Figure 4:
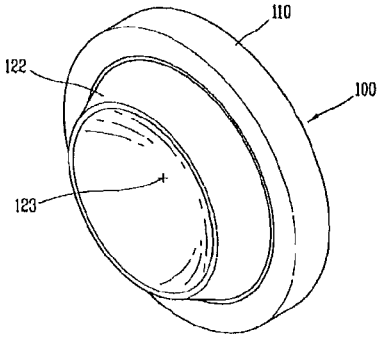

For example, as shown in FIGS. 3 and 4, the door glass 120 may be provided with a convex portion 122 formed at (extending from) one side of the fixed portion 121, fixed to the door frame 110, with a preset height toward the inside of the drum 2, and a concave portion 123 formed at an end surface of the convex portion 122 to be concave toward the outside of the drum 2 with a preset depth. Alternatively, the concave portion 123, as shown in FIGS. 3 and 4, may be formed to be curved or formed to be planar in a dimpled shape although not shown. The convex portion 122 may be formed such that an outer circumferential surface thereof is as long as interfering with an inlet of the lint filter 9. If possible, as shown in FIG. 3, the end surface of the convex portion 122 may be preferably formed to have a preset interval t from the lint filter 9 such that the end surface cannot overlap with the lint filter 9 on a horizontal line. Hence, the inner volume of the drum 2 can be enlarged and also a smooth air flow is allowed.

In the dryer having the door according to the present invention, as the concave portion 123 is formed at the end surface of the door glass 120, when putting clothes in the drum 2, the inner volume of the drum can be increased without increasing the size of the dryer, under consideration of the dryer with the same capacity, resulting in allowing a large quantity of clothes to be dried at once.

Figure 5:
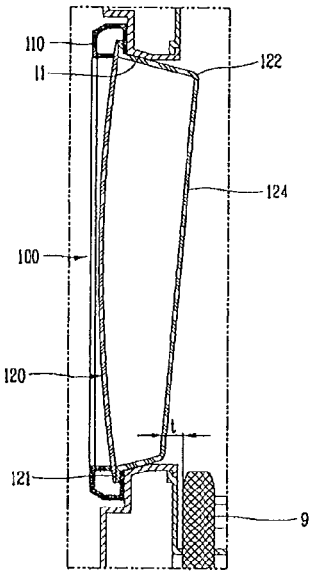
FIGS. 5 and 6 are longitudinal sectional view and perspective view, respectively, showing another embodiment of the door for the dryer of FIG. 1.
Figure 6:
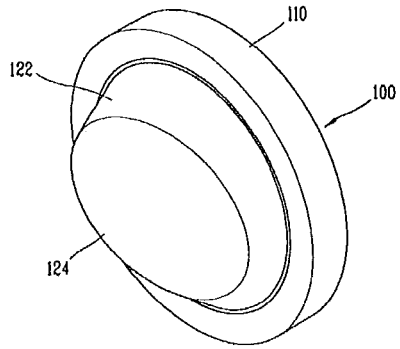

In the meantime, as shown in FIGS. 5 and 6, an inner surface of the door glass 120, namely, the end surface of the convex portion 122 may be formed to be inclined. In this case, the door glass 120 also has the fixed portion 121 and the convex portion 122. However, a concave portion may not be formed at the end surface of the convex portion 122 as shown in the previous embodiment, but the end surface of the convex portion 122 may be formed to be inclined, namely, an inclined portion 124 may be formed. Here, the inclined portion 124, as shown in the drawings, may be formed to be planar or formed to have a concavely curved surface. Here, an end of the inclined portion 124 close to the lint filter 9 may be preferably positioned in an approximately straight line with the lint filter 9, or have a preset interval t from the lint filter 9 such that the end of the inclined portion 124 can be positioned outer than the lint filter 9. Hence, the inner volume of the drum 2 can be enlarged and also air circulating in an inner space of the drum 2 can be smoothly guided to the lint filter 9.

In the dryer having the door according to the present invention, as the concave portion 123 is formed at the end surface of the door glass 120, when putting clothes in the drum 2, the inner volume of the drum 2 can be enlarged, as compared to other dryer with the same capacity, without increasing the size of the dryer, resulting in allowing a large quantity of clothes to be dried at once.

INDUSTRIAL AVAILABILITY

The door for the dryer according to the present invention may be applicable equally to a washing machine as well as the dryer.

INDEX

Dryer, door, door glass, concave

The invention claimed is:

1. A dryer comprising:

a main body having an inlet for clothes;

a drum installed inside the main body and communicated with the inlet to have an inner space for accommodating clothes to be dried;

a lint filter for filtering foreign materials out of air heat-exchanged with the clothes, the lint filter being disposed at an inside of the inlet of the main body; and a door configured to open and close the inlet of the main body, wherein the door comprises:

a door frame coupled to the main body; and a door glass coupled to the door frame, wherein the door glass has a convex portion protruded rearwardly toward the inner space of the drum to be inserted in the inlet, an end surface of the convex portion having an inclined portion inclined downwardly and forwardly from a top to a bottom of the convex portion, and wherein the convex portion close to the lint filter is located forwardly of the lint filter to not vertically overlap the lint filter.

2. The dryer of claim 1, wherein the door glass is provided with a concave portion recessed into an end surface of the convex portion in an opposite direction to the convex portion.

3. The dryer of claim 2, wherein the concave portion is formed to have a curved section or a dimpled section.

4. The dryer of claim 1, wherein the inclined portion is formed to have a planar section or a concave section.

5. The dryer of claim 1, wherein the inclined portion is inclined such that the height of the convex portion is lowered toward the lint filter.

6. The dryer of claim 1, wherein the door glass is formed of a transparent material for allowing the inner space of the drum to be viewable from the outside.

* * * * *